US006251055B1

(12) United States Patent
Evers et al.

(10) Patent No.: US 6,251,055 B1
(45) Date of Patent: Jun. 26, 2001

(54) SHEET FEEDING, FOLDING AND ACCUMULATING MACHINE

(75) Inventors: James C. Evers, Trumbull; William A. Ross, Darien; William A. Salancy, Norwalk, all of CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/569,016

(22) Filed: May 11, 2000

Related U.S. Application Data

(63) Continuation of application No. 09/001,213, filed on Dec. 30, 1997, now abandoned.

(51) Int. Cl.[7] ..... B31F 7/00

(52) U.S. Cl. ..... 493/419; 493/420; 493/421

(58) Field of Search ..... 493/419, 420, 493/421, 405, 402, 400, 23, 25, 26; 270/46, 58.02, 58.27; 53/117, 429

(56) References Cited

U.S. PATENT DOCUMENTS

| | | | | |
|---|---|---|---|---|
| 4,962,623 | * | 10/1990 | Francisco | 53/54 |
| 5,003,485 | * | 3/1991 | Francisco | 53/540 |
| 5,048,809 | * | 9/1991 | Tebbe et al. | 270/45 |
| 5,054,757 | * | 10/1991 | Martin et al. | 493/420 |
| 5,185,866 | * | 2/1993 | Francisco | 395/325 |
| 5,192,389 | * | 3/1993 | Martin | 493/421 |
| 5,242,364 | * | 9/1993 | Lehmann | 493/8 |
| 5,246,415 | * | 9/1993 | Fuss | 493/28 |
| 5,554,094 | * | 9/1996 | Viens | 493/419 |
| 5,556,086 | * | 9/1996 | Munneke et al. | 493/419 |
| 5,769,404 | * | 6/1998 | Kanou et al. | 270/37 |
| 5,769,774 | * | 6/1998 | Beck et al. | 493/419 |
| 5,871,433 | * | 2/1999 | Lehmann et al. | 493/420 |
| 6,004,254 | * | 12/1999 | Murata | 493/419 |
| 6,024,682 | * | 2/2000 | Mandel et al. | 493/419 |
| 6,059,711 | * | 5/2000 | Wang | 493/421 |

FOREIGN PATENT DOCUMENTS

| | | | | |
|---|---|---|---|---|
| 1205581 | * | 1/1968 | (GB) | 493/419 |

* cited by examiner

*Primary Examiner*—Stephen F. Gerrity
*Assistant Examiner*—Sam Tawfik
(74) *Attorney, Agent, or Firm*—Brian A. Lemm; Michael E. Melton

(57) ABSTRACT

A sheet feeding, folding and accumulating machine has an integral sheet storing and feeding mechanism, and a plurality of feeding inputs from which sheets are fed to a path of travel through the machine from the sheet storing and feeding mechanism or from an external source. A pair of buckle chutes are mounted in the machine, and suitable feeding and folding rollers are mounted adjacent the input ends of the buckle chutes for folding sheets that are fed into the buckle chutes. A movable buckle chute bypass gate is mounted adjacent the input end of each buckle chute, the gates being movable between opposite positions to cause sheets either to enter one or both of the buckle chutes or to bypass the buckle chutes and proceed directly to an accumulating mechanism that is mounted adjacent an outlet end of the machine to control whether each sheet will be folded or not folded before being deposited in the accumulating device.

13 Claims, 7 Drawing Sheets

SHEET FEEDING, FOLDING AND ACCUMULATING MACHINE

CROSS REFERENCES TO RELATED APPLICATIONS

This Application is a continuation of application Ser. No. 09/001,213 filed Dec. 30, 1997, now abandoned.

BACKGROUND OF THE INVENTION

This invention relates generally to the field of sheet feeding, folding and accumulating machines, and more particularly to a unified sheet feeding, folding and accumulating machine in which documents fed successively through the machine from a plurality of input sources can be folded or not folded as may be desired, and accumulated within the machine as discrete collations ready to be inserted into envelopes.

High speed document processing and mailing apparatus have become widely accepted in the automated mailing field, particularly in high volume applications where various documents are handled in connection with the preparation of mail at a high rate of speed. During recent decades, the complexities of modern mailing have increased considerably due both to the complex characteristics of individual mail pieces and the volume and speed at which they must be produced.

In a typical situation involving the preparation of individual mail pieces, such as that generated by mass mailers such as banks, insurance companies, mail order catalog businesses, utility companies, book clubs, etc., to name a few, an individual item of mail might consist of a computer generated invoice for a customer consisting of at least one, possibly two or three pages, a return payment envelope, one or more individual advertising flyers, an information announcement of a change in service or policy, a sweepstake entry, and other documents which make up the half a dozen or more individual items which are found in the mailing envelope. Frequently one or some of these documents require that they be folded in order to fit within the mailing envelope, while others are created in a size that will fit into the envelope. Further, it is possible that one or some of the folded items are small enough to require only bi-folding to fit into the mailing envelope, while others may be sufficiently large to require tri-folding in order to fit into the envelope.

In addition to folding, it is often desirable that the individual items included in the mail piece must be collated in a particular manner so that they are in a desired sequence when removed by the recipient from the mailing envelope. This collating feature requires that various types of sheet feeding and accumulating equipment must be provided to arrange all of the items in the mail piece in the desired sequence.

In a typical installation utilizing heretofore known components to accomplish the foregoing steps in the process of creating a plurality of mail pieces, a computer generates a succession of customer invoices on a web of computer paper, which, in the case of a multiple page invoice, is then fed through slitting, separating and accumulating mechanisms to create a properly arranged invoice. The invoice may then either be fed through a folding machine for appropriate folding if required to fit within a mailing envelope, or it can be fed directly along a conveyor past a series of sheet feeding machines which add various types of folded or unfolded insert material, such as those mentioned above, to the invoices, and then into an accumulating machine that appropriately organizes and aligns all of the material as desired to form the ultimate collation of material to be place in a mailing envelope. The collation is then fed into an inserting machine in which an envelope has been previously transported from a storage position to an inserting position at which the throat of the envelope is held open to receive the collation. After the collation is fully inserted into the envelope, the envelope is ejected from the inserting machine and fed into a mailing machine where the flap of the envelope is closed and sealed, and a postage indicia is applied to the envelope, which is then stacked in a suitable manner for mailing or other processing.

It should be understood that all of the foregoing steps in the mailing process are representative of a typical situation, and that some may be omitted an others added, but that, in any event, all of the steps utilized are carried out at a high rate of speed, typically about 4000 mail pieces per hour. To accomplish this, several individual sheet handling components must be assembled together and mechanically and electrically united into an integral sheet handling apparatus, which can involve five or six individual components. While these systems have achieved considerable commercial success, they still have certain disadvantages, of which considerable space requirement and cost of purchase and maintenance are perhaps the most significant. It is not uncommon for a full mail processing apparatus, from computer to envelope stacker, to run many feet in length and cost as much as 15,000 thousand dollars.

Thus, there is an ongoing need to find procedures and to design equipment to carry them out by which various steps in the overall mail processing system can be combined into a single component, thereby decreasing the space requirement and cost of purchase and operation of the full mail processing apparatus.

BRIEF SUMMARY OF THE INVENTION

The present invention substantially obviates if not entirely eliminates the foregoing problems by providing a sheet processing machine which has the capability of performing the functions of at least two, and in some cases three, separate prior art sheet handling components, and doing so in an innovative and highly efficient manner. The machine of the present invention is a dual fold sheet folding machine having at least one integral sheet feeding device adjacent an inlet end of the unified machine and an accumulating device adjacent an outlet end of the folding machine. Thus, the sheet processing machine of the present invention combines into a single machine a folding mechanism for selectively folding or not folding previously processed material passing through the machine, at least one feeding device for adding insert material to the previously processed material passing through the machine, the added material also being selectively folded or not folded as desired, and an accumulating device for accumulating and appropriately organizing all of the material constituting a single collation and feeding the completed collation to an envelope inserting machine. The machine of the present invention thereby eliminates the need for separate machines to accomplish these functions, at least to the extent that no greater number of pieces of insert material is required than that which the feeding devices in the sheet processing machine can provide.

In some its broader aspects, the principles of the present invention are embodied in a sheet processing machine for selectively feeding and folding sheets either stored in the machine or fed to the machine from an external source, and for accumulating the sheets to form collations thereof for further processing. In this environment, the processing machine comprises first and second sets of feeding and folding rollers defining a main path of travel for sheets through a portion of the machine and having upstream and a downstream ends, and a sheet storage and feeding means mounted adjacent the upstream end of the main path of travel for storing sheets to be formed into discrete collations. First and second input feeding means for feeding sheets from the sheet storage and feeding means and from an external source respectively, the first and second input feeding means being disposed adjacent the upstream end of the main path of travel for feeding sheets into the main path of travel from both the sheet storage and feeding means and the external source. The processing machine also includes first and second buckle chutes having inlet ends disposed in operative relationship with the first and second sets of feeding and folding rollers respectively for selectively receiving sheets to be folded from the first and second sets of feeding and folding rollers. A sheet accumulating means is disposed adjacent the downstream end of the main path of travel for accumulating sheets fed either directly through the main path of travel to the accumulating means, or through one or the other or both of the buckle chutes and then to the accumulating means. Finally, there is sheet directing means disposed adjacent the inlet ends of the first and second buckle chutes for directing sheets from either of the first or second input feeding means either directly through the first and second sets of feeding and folding rollers along the main path of travel to the accumulating means, or alternatively for diverting the sheets out of the main path of travel and into one or the other or both of the buckle chutes for folding. With this arrangement, sheets from either the storage and feeding means or the external source can be fed to the accumulating means either directly along the main path of travel without being folded to form discrete collations of unfolded sheets, or can be fed selectively to either of the first or second buckle chutes, or both, to be folded in different configurations and then fed to the accumulating means to form discrete collations of both unfolded and folded sheets.

In some of its more limited aspects, the first input feeding means is disposed intermediate the sheet storage and feeding means and the first set of feeding and folding rollers, and defines a first entrance path along which sheets in the sheet storage and feeding means are fed therefrom to the first set of feeding and folding rollers. The second input feeding means is disposed intermediate the input end of the machine and the first set of feeding and folding rollers and defines a second entrance path along which sheets from the external source are fed from the input end of the machine to the first set of feeding and folding rollers, so that the first and second entrance paths direct sheets from the sheet storage and feeding means and the external source, respectively, to the main path of travel.

The first and second sets of feeding and folding rollers each comprise first, second and third feeding rollers mounted so as to have the peripheries of the first and second rollers and the second and third rollers in cooperating feeding engagement with each other, the first and third rollers being mounted so as to have the peripheries thereof in spaced relationship with each other, and the means for directing sheets into the buckle chutes being disposed in the space between the first and third rollers of each of the first and second sets of feeding and folding rollers.

The means for directing sheets into the buckle chutes comprises first and second gating means mounted for movement between alternate positions for selectively directing sheets out of the main path of travel and into the inlet ends of the buckle chutes when the sheets are to be folded, the first and second gating means each comprising an elongated gate element mounted to extend laterally across the main path of travel and for oscillatory movement between first and second positions. The gate elements have a guide surface for directing sheets from the first and second rollers of each of the sets of feeding and folding rollers into the inlet ends of the buckle chutes or alternatively from the first and second rollers directly to the second and third rollers depending on whether the gate elements are disposed in the first or second position. Selectively operable means controls the movement of the gate elements through the oscillatory movement between the first and second positions.

Having briefly described the general nature of the present invention, it is a principal object thereof to provide a sheet processing machine in which collations can be made preparatory to insertion into envelopes containing selectively either folded, unfolded or a mixture of both folded and unfolded material.

Another object of the present invention is to provide a sheet processing machine in which the collations of folded, unfolded or a mixture of both folded and unfolded material can be made from sheets stored within the processing machine, from sheets fed to the processing machine from an external source, or a mixture of sheets stored within the processing machine and those fed to the processing machine from an external source.

Still another object of the present invention is to provide a sheet processing machine in which the functions of adding insert material to previously processed material, selectively folding or not folding either the previously processed material or the added insert material or both, and accumulating and organizing all of the material into a discrete collation are carried out in a single sheet processing machine.

These and other objects and advantages of the present invention will be more apparent from an understanding of the following detailed description of a presently preferred mode of carrying out the principles of the invention, when considered in conjunction with the accompanying drawings.

DETAILED DESCRIPTION OF THE INVENTION

Figure 1:
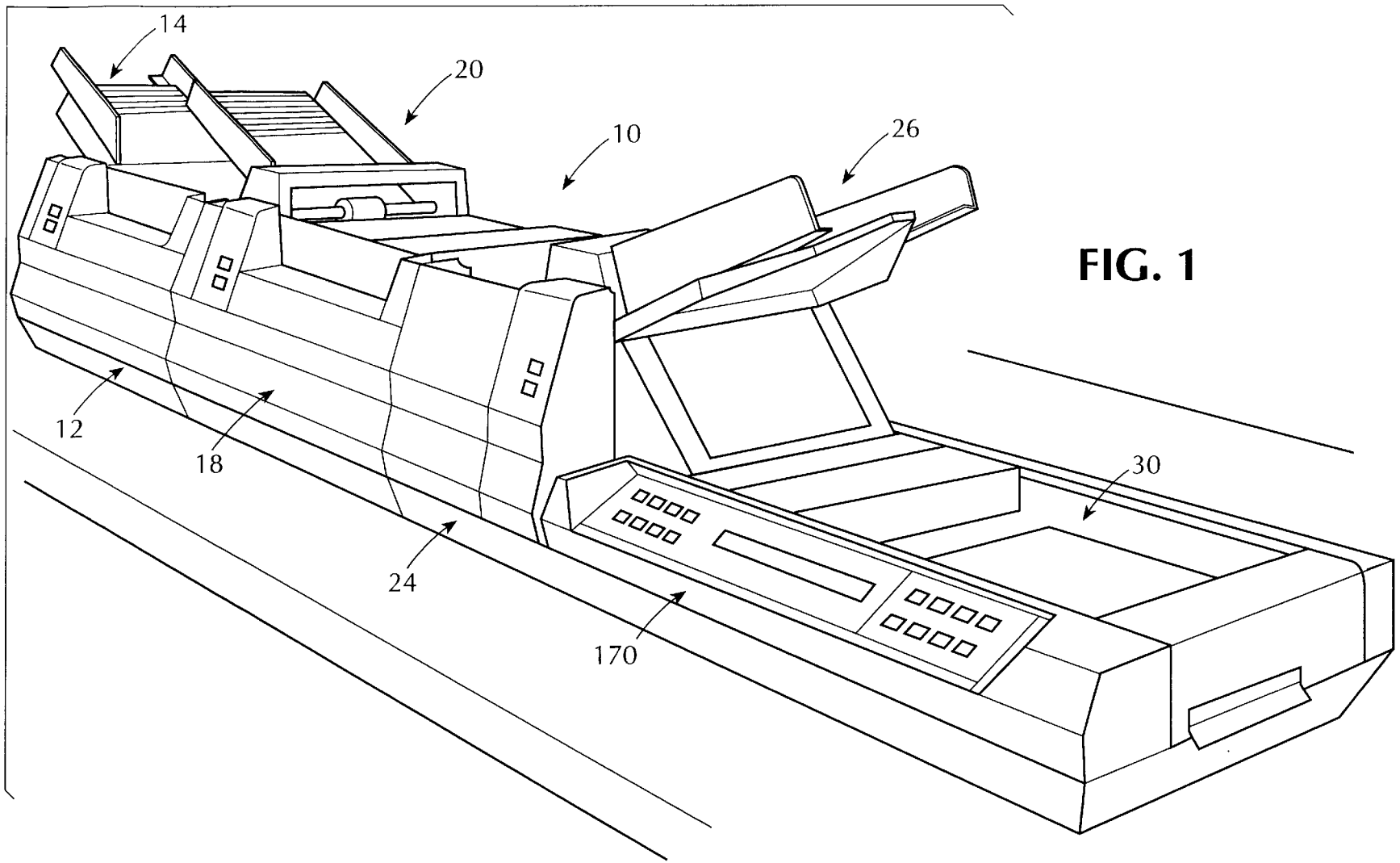
FIG. 1 is a perspective view of a typical sheet processing apparatus with which the sheet feeding folding and accumulating machine of the present invention is an integral component.

Referring now to the drawings, and more particularly to FIG. 1 thereof, the sheet feeding, folding and accumulating machine of the present invention is normally utilized as an integral component of a larger and more complex document processing apparatus, although it could, if desired, be utilized as a stand alone machine. For purposes of illustration, however, the sheet feeding, folding and accumulating machine of the present invention is illustrated and described herein as a component of a document processing apparatus, designated generally in FIG. 1 by the reference numeral 10, and which comprises one or more identical document feeders, as indicated by the document feeder generally designated by the reference numeral 12. These feeders are generally well known in the art, and have document storage and feeding means designated generally by the reference numeral 14 for storing and feeding a plurality of sheets or other type of insert material which will form part of a collation that is to be inserted into an envelope for mailing, as will be more clearly seen hereinafter. Since these feeders are well known, further description thereof is not believed to be necessary. Although not shown, the document feeder 12 (which reference hereinafter is intended to include any number of such feeders) is mounted in overlying relationship with an elongate document conveyor of any suitable construction, a fragmentary portion of which is seen at the left side of FIG. 4 and designated generally by the reference numeral 16. The document conveyor transports the documents from an originating machine, such as a high speed, automated computer printer which generates a basic document, past the document feeder 12 which adds further material to the basic document, and into the sheet feeding, folding and accumulating machine of the present invention, designated generally by the reference numeral 18 in FIG. 1.

As will be seen in more detail hereinbelow, the sheet feeding, folding and accumulating machine 18 is also mounted in overlying relationship with the elongate conveyor 16, and includes a document feeder, designated generally by the reference numeral 20 in FIGS. 1 and 4, which may be substantially the same as the document feeder 12, and which functions to provide additional sheets or other insert material to the collation that is already formed by the originating machine and the document feeder 12, and which may or may not be folded, as will also be more clearly seen hereinafter. The sheet feeding, folding and accumulating machine 18 further includes an accumulating mechanism, designated generally by the reference numeral 22 in FIG. 4, in which the final collations consisting of folded, unfolded or a mix of folded and unfolded sheets and/or other insert material are finally accumulated just prior to being fed to an envelope inserting component and inserted into envelopes. The accumulating mechanism 22 is well known in the art and need not be described in detail, other than to note that it consists of a plurality of belts 23 driven by rollers 25 mounted on a shaft 27 supported in the frame 30, and a pair of back up rollers 29 suitably supported on a secondary frame further described below engage the belts 23 as they pass over the drive rollers 25 to move collations of sheets and other insert materials to a location where they are suitably arranged for insertion into an envelope in the aforementioned inserting component.

Figure 2:
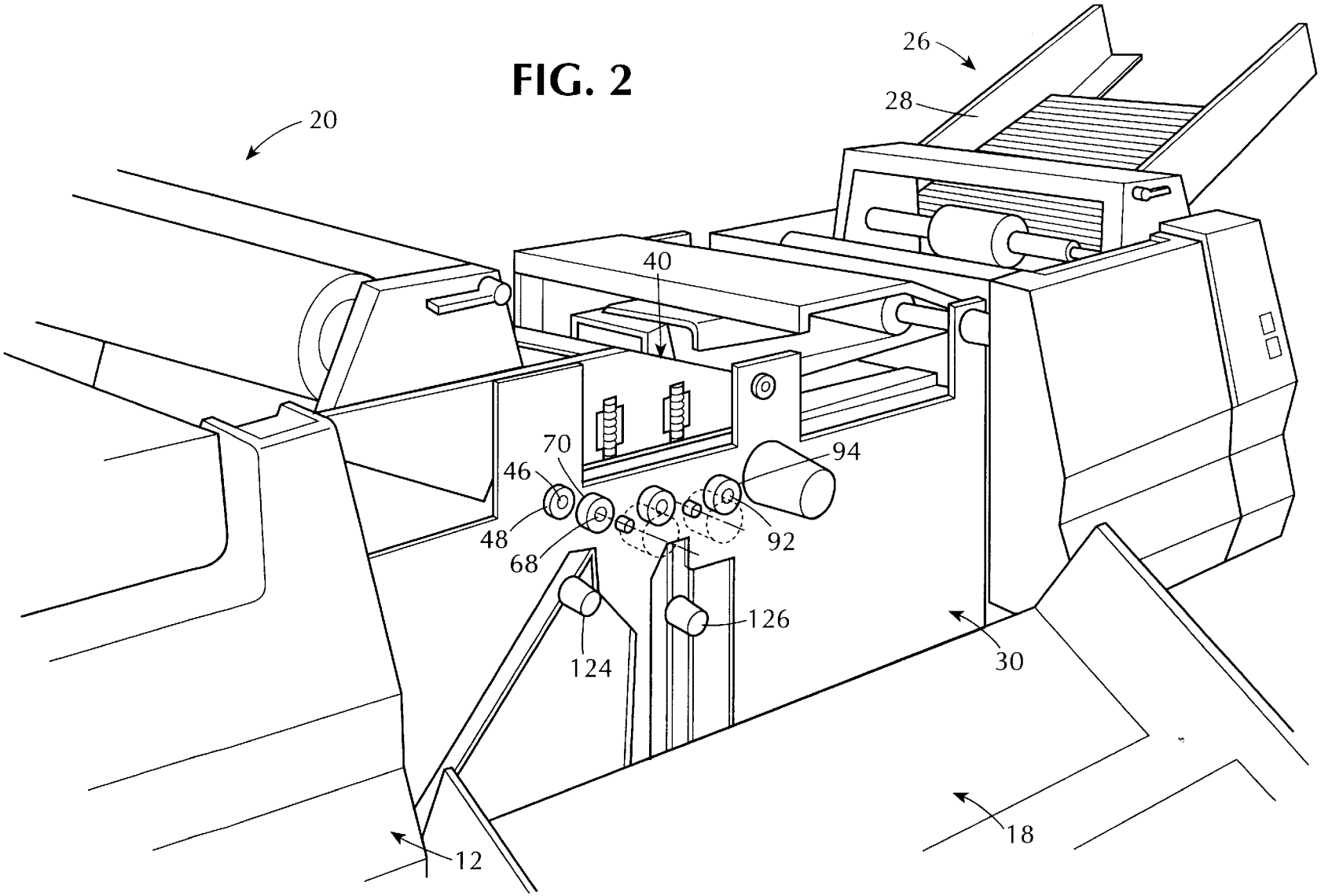
FIG. 2 is a perspective view of a portion of the sheet processing apparatus shown in FIG. 1, looking in the opposite direction from that of FIG. 1, showing certain details of the sheet feeding, folding and accumulating machine of the present invention.

This last function is carried out in any one of a number of well known envelope inserting machines, designated generally by the reference numeral 24 in FIGS. 1 and 2. As was the case with the document feeder 12, these machines are also well known in the art and therefore further description thereof is not deemed necessary, other than to note that they are provided with an envelope feeder, designated generally by the reference numeral 26 in FIGS. 1 and 2. The envelope feeder 26 feeds envelopes seriatim from a storage hopper 28 to an inserting mechanism (not shown) which inserts the collations accumulated in the accumulating mechanism 22 into the envelopes, after which it discharges the filled envelopes into a receiving area, designated generally by the reference 30 in FIG. 1 for further processing as may be desired, such as being passed through a scale and a mailing machine which prints an appropriate postage indicia on each envelope as evidence of payment of postage.

Figure 3:
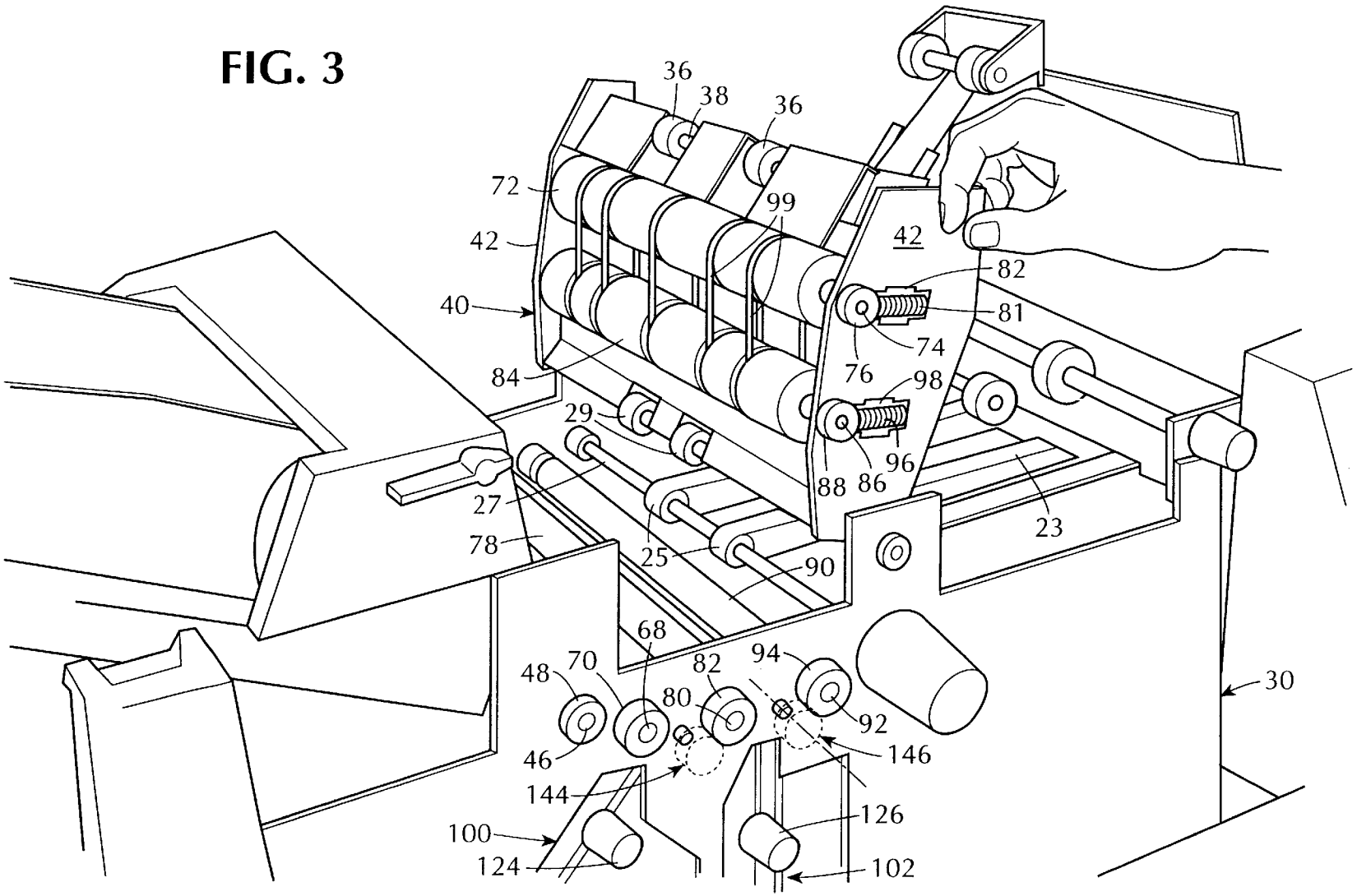
FIG. 3 is a perspective view, looking in the same direction as in FIG. 2, of a portion of the inside of the sheet feeding, folding and accumulating machine of the present invention.
Figure 4:
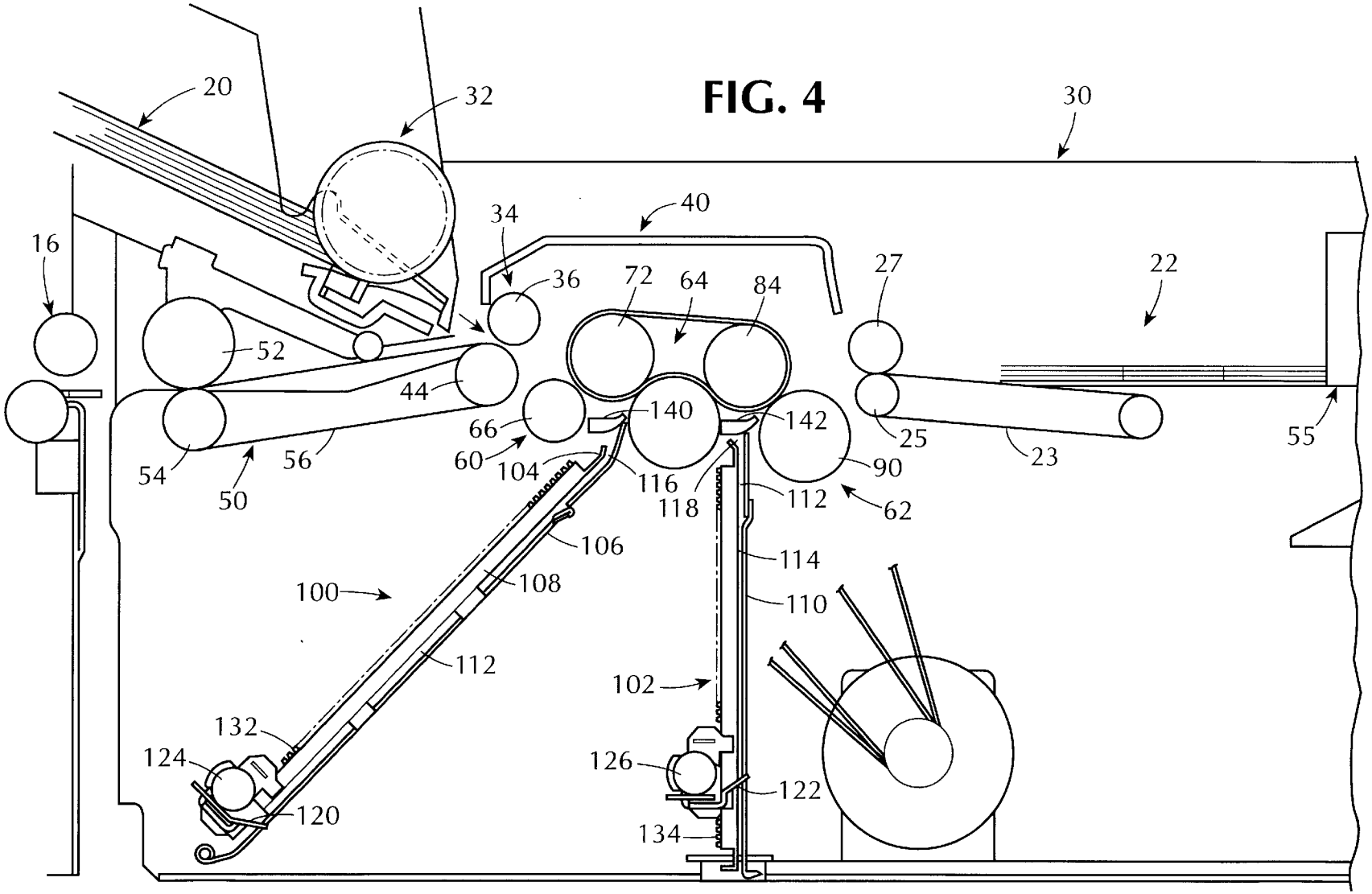
FIG. 4 is a longitudinal side view of the interior of the sheet feeding, folding and accumulating machine of the present invention.

Referring now particularly to FIGS. 3 and 4, the sheet feeding, folding and accumulating machine 18 comprises a suitable frame, designated generally by the reference numeral 30, the frame 30 generally including a pair of upstanding parallel plates which support all of the operating parts and sub-assemblies yet to be described. The aforementioned document feeding device 20 is suitably supported on the frame 30 adjacent an inlet end of the sheet feeding, folding and accumulating machine 18, and includes a suitable well known sheet feeding mechanism, designated generally by the reference numeral 32 in FIG. 4 which feeds sheets one at a time into a first input feeding means designated generally by the reference numeral 34 in FIG. 4. The input feeding means 34 comprises a plurality of upper rollers 36 rotatably mounted on a shaft 38 (FIG. 3) supported by a secondary frame, designated generally by the reference numeral 40 (FIGS. 3 and 4), which in turn comprises a pair of relatively small side plates 42 pivotally connected to the frame 30 so as to be movable from the closed position shown in FIG. 4 to the open position shown in FIG. 3 to permit access to the interior portion of the machine 18 for clearing paper jams and for any necessary service. The input feeding means 34 also comprises a suitable backup roller 44 mounted on a shaft 46 which is rotatably mounted in bearings 48 mounted in the frame 30.

The machine 18 includes a second input feeding means designated generally by the reference numeral 50 in FIG. 4. The second input feeding means 50 comprises an upper roller 52 suitably mounted on the document feeder 20, which cooperates with a lower roller 54 also mounted in the frame 30. One or more suitable support belts 56 are connected between the rollers 54 and 44 to support sheet material which is fed into the machine 18 from any external source as represented by the document conveyor 16, such as an adjacent document feeder 12. It will be seen from the description thus far that the first input feeding means 34 constitutes a juncture between the first input feeding means 34 and the second input feeding means 50 so that insert material passes through the first input feeding means 34 regardless of whether it originates from the document feeder 20 of the machine 18 or any upstream sheet handling component, such as an adjacent document feeder 12.

The secondary frame 40 and the main frame 30 support a pair of first and second sets of feeding and folding rollers, designated generally by the reference numerals 60 and 62 respectively in FIG. 4, which together define a main path of travel, designated generally by the reference numeral 64 in FIG. 4, for sheets being fed through the feeding, folding and accumulating machine 18 between the first and second input ends 34 and 50 and an output end, designated generally by the reference numeral 55, disposed adjacent the accumulating device 22. Referring now to FIGS. 3 and 4, the first set of feeding and folding rollers 60 comprises a lower roller 66 mounted on a shaft 68 which is rotatably mounted in a bearing 70 mounted in the frame 30. An upper roller 72 is mounted on a shaft 74 which is rotatably mounted in a bearing 76 mounted in the secondary frame 40. Finally, another lower roller 78 is mounted on a shaft 80 which is rotatably mounted in a bearing 82 mounted in the frame 30. The shaft 74 for the roller 72 is biased downwardly with respect to the secondary frame 40 by means of a spring 81 captured in a suitable bracket 82 so as to maintain the roller 72 in firm driving engagement with the adjacent rollers 66 and 78.

The second set of feeding and folding rollers 62 is substantially identical to the first set of feeding and folding rollers 60, and comprises the lower roller 78, which is common to both the first and second set of feeding and folding rollers 60 and 62, an upper roller 84 mounted on a shaft 86 rotatably mounted in a bearing 88 mounted on the secondary frame 40, and another lower roller 90 mounted on a shaft 92 rotatably mounted in a bearing 94 mounted in the frame 30. As with the upper roller 72, the shaft 86 for the upper roller 84 is urged downwardly with respect to the secondary frame 40 by means a spring 96 captured in a bracket 98, to maintain the roller 84 in firm driving engagement with the adjacent rollers 78 and 90. As best seen in FIG. 3, the upper rollers 72 and 84 are provided with a plurality of O-ring belts 99 which lie in suitable grooves formed in the peripheral surfaces of the rollers 72 and 84 to ensure that sheets passing over the lower roller 78 follow the prescribed paper path 64 and do not get misdirected into the space between the upper rollers 72 and 84.

Still referring to FIG. 4, first and second buckle chutes, designated generally by the reference numerals 100 and 102, are suitably mounted in the frame 30, the first buckle chute 100 being the longer of the two and mounted at an angle to the longitudinal axis of the sheet feeding, folding and accumulating machine 18, the second buckle chute 102 being mounted substantially perpendicular to the longitudinal axis. The buckle chutes 100 and 102 are generally of well known construction and therefore need not be described in detail, other than to note that they comprise generally a pair of closely spaced parallel plates 104/106 and 108/110 respectively so as to define a sheet receptacle 112 and 114 therebetween. The buckle chutes 100 and 102 are also provided with entrance openings 116 and 118 respectively which are disposed adjacent the first and second sets of feeding and folding rollers 60 and 62 respectively, so that the buckle chutes 100 and 102 are disposed in operative relationship with the first and second sets of feeding and folding rollers 60 and 62 to receive sheets therefrom for folding in a manner more fully described below.

The buckle chutes 100 and 102 further include adjustable back stops 120 and 122 respectively which are manually set to any desired position along the length of the buckle chutes 100 and 102 by means of adjusting knobs 124 and 126 which rotate gears 128 and 130 (FIG. 5) which engage with racks 132 and 134 formed along the outer surface of the plates 104 and 106. Since the buckle chutes 100/102 are of well known construction, it should be apparent without further description that rotation of the knobs 124 and 126 moves the back stops 120 and 122 along the interior spaces 112 and 114 in order to adjust the length of sheet that will fit into the buckle chutes before a crease is formed in the manner further described below.

Figure 7:
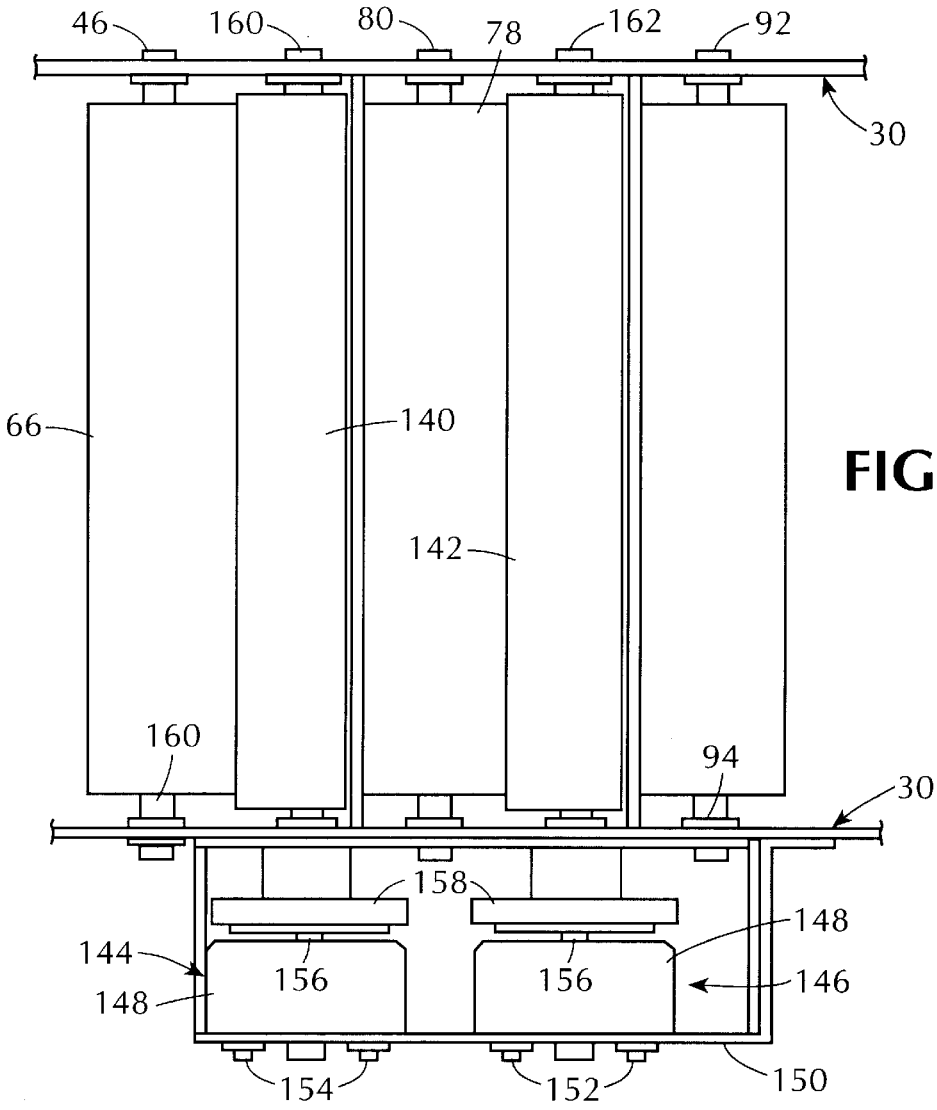
FIG. 7 is a plan view showing certain details of the feeding and folding rollers, the buckle chute bypass gates and the solenoids for actuating the bypass gates.
Figure 8:
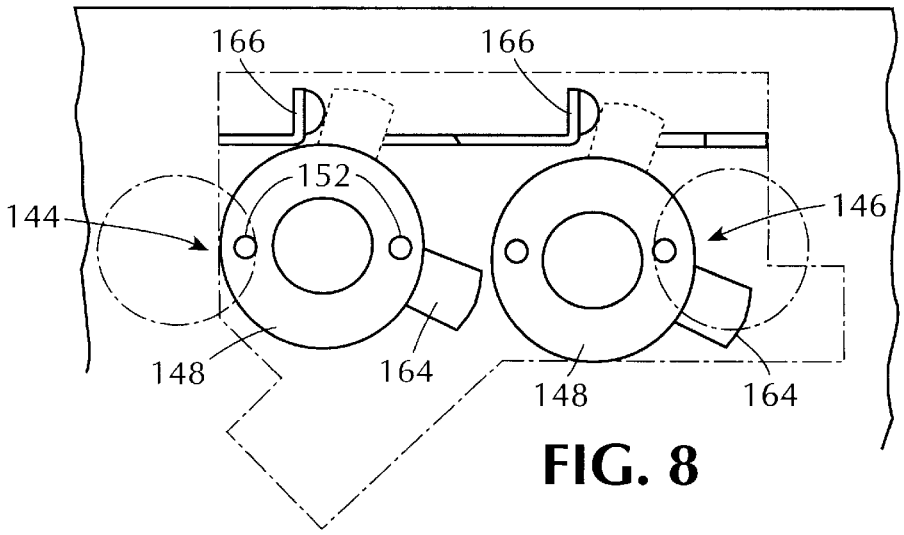
FIG. 8 is a side view of the solenoids that actuate the buckle chute bypass gates.

Means are provided for directing incoming sheets and other insert material selectively along the main path of travel without entering either of the buckle chutes 100 or 102, or entering either one or both of the buckle chutes 100 or 102 in order to prevent sheets from being folded at all or to cause selected sheets to be folded in one of several fold formats. Thus, in the preferred embodiment of the invention, this means comprises first and second buckle chute bypass gating means 136 and 138 respectively (FIG. 5), each disposed adjacent the inlet ends 116 and 118 of the first and second buckle chutes 100 and 102, the gating means 136 and 138 being selectively operable for movement between alternate positions for directing sheets or other insert material from either of the first and second input feeding means 34 and 50 either through the first and second sets of feeding and folding rollers 60 and 62 directly to the accumulating mechanism 22, or alternatively through one or the other, or both, of the buckle chutes 100 and 102 for folding of the sheets or other insert material and then to the accumulating mechanism 22. With particular reference to FIGS. 4, 7 and 8, the bypass gating means 136 and 138 are structurally identical and comprise generally rectangular gate elements 140 and 142 which are suitably pivotally mounted in the frame 30 for movement between first and second positions, in the first of which the bypass gate elements 140 and 142 prevent sheets from entering the inlet ends 116 and 118 of the chutes 100 and 102, as seen in FIG. 5, and in the second of which the bypass gate elements 140 and 142 direct the sheets into the inlet ends 116 and 118 of the buckle chutes 100 and 102 to cause the sheets or other insert material to be folded, in the manner more fully described below.

Figure 5:
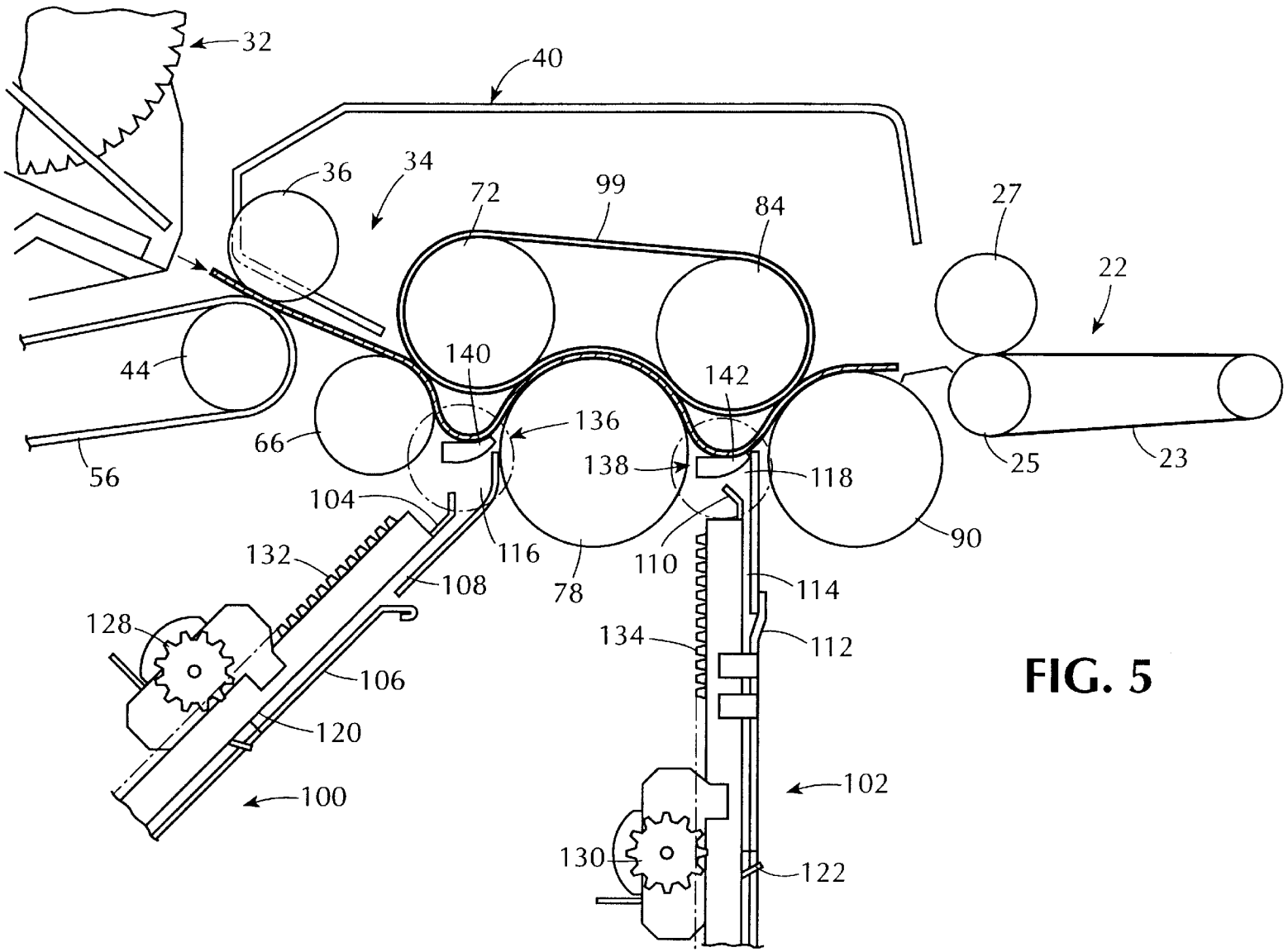
FIG. 5 is a view similar to FIG. 4, drawn to an enlarged scale, and showing the buckle chute bypass gates in the position they occupy to cause sheets to bypass the buckle chutes and proceed directly from the inlet to the accumulating mechanism.
Figure 6:
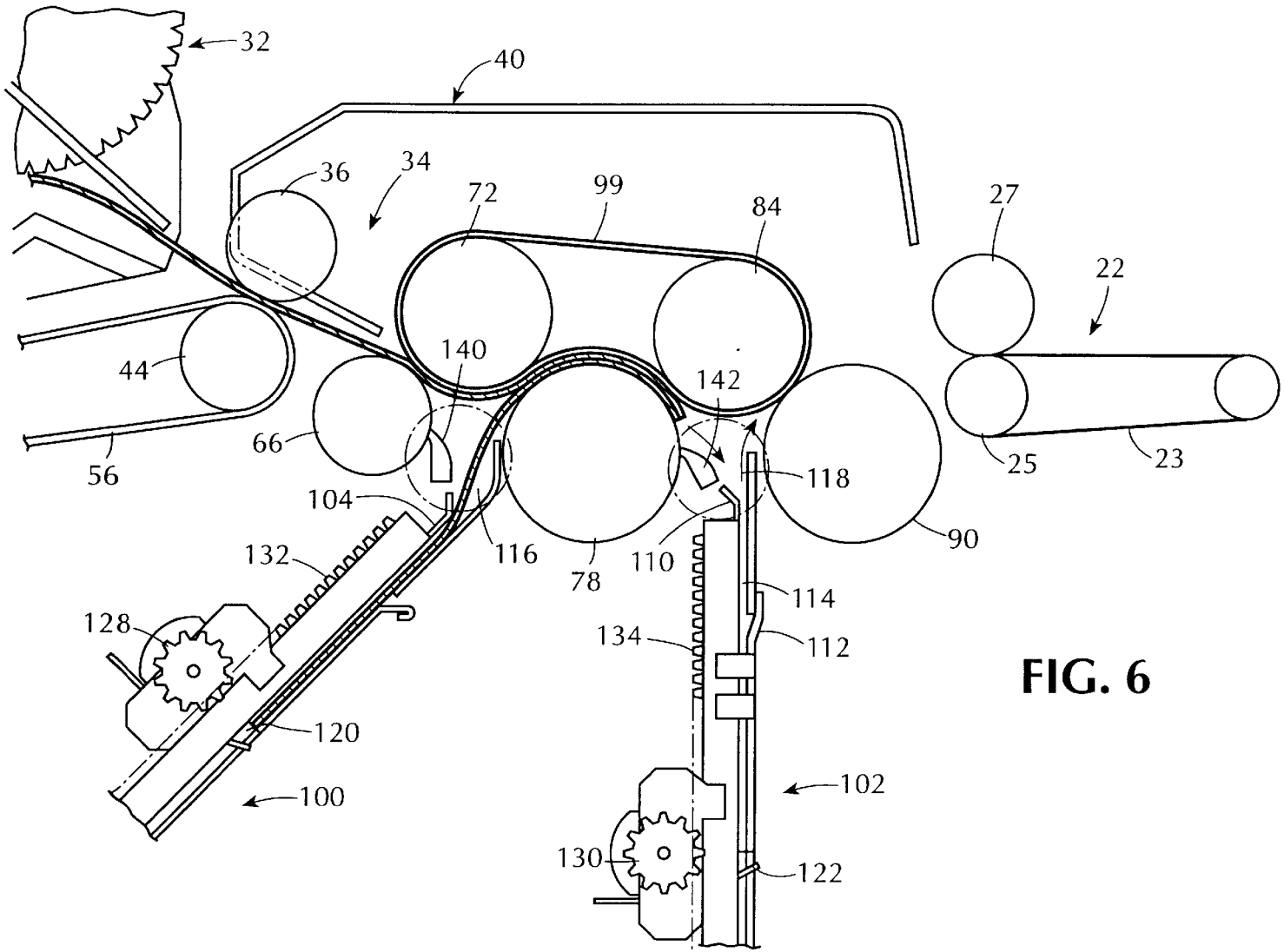
FIG. 6 is a view similar to FIG. 5, showing the buckle chute bypass gates in the position they occupy to cause sheets to enter the buckle chutes for folding.

With reference to FIGS. 5 through 8, each gate element 140 and 142 comprises an elongated, generally triangular in cross section integral member which extends between, and is suitably pivotally mounted in, the side plates of the frame 30, the gate elements 140 and 142 being positioned so as to obstruct passage of sheets into the buckle chutes 100 and 102 when the gate elements 140 and 142 are in the first position shown in FIG. 5, and to permit passage of the leading edge of sheets into the buckle chutes 100 and 102 when the gate elements 140 and 142 are in the second position shown in FIG. 6. As best see in FIG. 7, the gate elements 140 and 142 are connected to a drive means for moving the gate elements between the first and second positions, and in the preferred embodiment of the invention this means comprises a pair of rotary solenoids designated generally by the reference numerals 144 and 146 respectively. Each solenoid has a housing 148 suitably mounted on a bracket 150 which is connected to the frame 30 as by screws 152 and locking nuts 154. Each solenoid has an armature 156 which is spring loaded in one direction of rotation when the solenoid is deenergized and is urged in the opposite direction of rotation when the solenoid is energized. The armatures 156 of the solenoids 144 and 146 are connected through suitable couplings 158 to a pair of shafts 160 and 162 to which the gate elements 140 and 142 are respectively connected.

Each solenoid 144 and 146 is provided with radially projecting finger 164 which is suitably internally connected to the armature 156 and which rotates therewith, the finger 164 being shown in solid lines in FIG. 8 in the position it occupies when the solenoid is deenergized and the gate elements 140 and 142 are in the positions shown in FIG. 5 where they obstruct passage of sheets into the buckle chutes 100 and 102 so that they travel directly to the accumulator mechanism 22. When the solenoids 144 and 146 are energized, the armatures 156 rotate approximately 90° to bring the fingers 164 to the dotted line positions shown in FIG. 8, where they abut a pair of adjustable bumpers 166 which limit the rotary movement of the armatures 156, thereby moving the gate elements 140 and 142 to the positions shown in FIG. 6 to permit passage of sheets into the buckle chutes 100 and 102.

With the foregoing description in mind, the operation of the sheet processing machine 18 of the present invention will now be described. Firstly, it should be recalled from earlier description that the sheet processing machine 18 is typically one component of a larger document processing apparatus 10, as shown in FIG. 1, and typically there is a master control panel, such as that designated generally by the reference numeral 170 in FIG. 1, which is the user operated data input mechanism for a suitable microprocessor (not shown) which controls the sequence of operation of all of the components in the apparatus 10, which would include the sheet processing machine 18. It should also be remembered, however, that the sheet processing machine 18 can also be used as a stand alone machine in certain limited situations, in which case the control system is much simpler than when the machine 18 is part of a larger document processing apparatus. For the benefit of full illustration, it will be assumed in the description that follows that the sheet processing machine 18 is a component of the larger document processing apparatus 10 shown in FIG. 1, and that the master control panel 170 controls all of the components in the system. It should be still further understood that the description of synchronization of operation of all the components in the system is limited to only so much detail as is necessary to an understanding of the operation of the sheet processing machine 18.

Thus, for the sake of illustration, it will be assumed that the sheet processing apparatus 10 has been set up to perform a particular job comprising the preparation of many thousands of identical mail pieces in which a customer invoice is printed by an upstream printing component, which are then fed past a pair of insert material feeders 12, one of which contains advertising flyers and the other contains return envelopes for payment of the invoice. It is also assumed that the sheet feeder 20 within the sheet processing machine 18 contains an information pamphlet relating to services offered by the mailer. All of these materials are to be inserted into mailing envelopes stored in the inserting machine 24. It is further assumed that the invoices and the advertising folders must be tri-folded in order to fit into the mailing envelopes, but the information pamphlets are of a size that requires only that they be bi-folded to fit into the mailing envelopes. The return envelope need not be folded at all. It is still further assumed that all of the materials are to be folded and stacked individually before being inserted into the mailing envelopes, thereby eliminating the need for an accumulating device between the sheet processing machine 18 and the last feeder 12 along the conveyor 16.

With these parameters established, the operator manipulates the control panel 170 in a manner known in the art to enter the appropriate data to achieve the desired sequence of operations of the components into the microprocessor. For example, the order of this sequence could be, first, for the printing component to feed a printed invoice along the conveyor 16 to and into the second or external source input 50 of the sheet processing machine 18, which directs it successively into the first or internal source feeding means 34, and from there to the first set of feeding and folding rollers 60. Since the invoice sheet is to be tri-fold, the microprocessor will have been programmed to actuate the solenoid 144 to move the gate element 140 from the first or normal position shown in FIG. 5 to the second or diverting position shown in FIG. 6, so that the gate element 140 diverts the lead edge of the invoice out of the main path of travel and into the entrance opening 116 of the first buckle chute 100. When the lead edge of the invoice abuts the stop member 120, a buckle is formed adjacent the rollers 72 and 78, and further feeding of the invoice by the rollers 66 and 72 causes the buckle to be captured by the rollers 72 and 78, which impart a crease in the area of the buckle, there by forming the first fold in the invoice and form a new lead edge.

Again, since the microprocessor was programmed to provide a tri-fold configuration to the invoice sheet, the solenoid 146 will have been energized to move the gate element 142 from the FIG. 5 position to the FIG. 6 position, thereby directing the new lead edge of the partly folded invoice sheet into the entrance opening 118 of the buckle chute 102. When the lead edge abuts the stop member 122, a buckle is formed in the area of the rollers 84 and 90, and further feeding of the invoice sheet by the rollers 78 and 84 will cause the buckle to be captured by the rollers 84 and 90 which again causes a crease to be formed in the area of the buckle to form the buckle to form the second fold, resulting in the invoice now being folded into thirds. The invoice is then fed by the rollers 84 and 90 into the accumulating device 22 in which it stored until the collation to be inserted into the appropriate mailing envelope is completed.

The next sequence of events is that, as soon as the folded invoice reaches the accumulating device 22, the first of the two feeders 12 containing the advertising flyers feeds an advertising flyer onto the conveyor 16 which directs it along the same path as that followed by the invoice so that it also enters the processing machine 12 and is tri-folded in the same manner as that described above and placed on the invoice in the accumulating device 22. During this operation, since the microprocessor knows that the second sheet to be fed into the processing machine 18 is also going to be tri-folded, it maintains the solenoids 144 and 146 energized so as the maintain the gate elements 140 and 142 in the diverting positions shown in FIG. 6.

Next, as soon as the folded advertising flyer is deposited on the invoice in the accumulating device 22, the feeder 12 containing the return envelopes feeds a return envelope onto the conveyor 16 which directs it along the same external source path 50 into the processing machine 18 as that followed by the invoice and the advertising flyer. But since the microprocessor has been programmed not to fold the envelope, but rather to cause it to remain in the main path of travel and proceed directly to the accumulating device 22, the solenoids 144 and 146 are deenergized so that the gate elements 140 and 142 are moved from the diverting positions shown in FIG. 6 to the non-diverting positions shown in FIG. 5 so as to cause the envelope to bypass the entrance openings 116 and 118 into the buckle chutes 100 and 102. This causes the envelope to remain in the main path of travel and proceed directly to the accumulating device 22, where it becomes part of the collation to be inserted into the mailing envelopes.

Finally, as soon as the return envelope enters the accumulating device 22, the internal sheet storing and feeding means 20 feeds an information pamphlet into the second input means 34. The operator has a choice of which of the buckle chutes 100 or 102 the information pamphlet should be directed into, depending on the size of the unfolded sheet on which the pamphlet information is printed. Thus, if the sheet of paper is such that, when folded once, the fold will be created in the middle of the sheet, and if the back stop 122 of the downstream buckle chute 102 is set to produce a fold in the middle of that size of sheet, then the gate element 140 for the upstream buckle chute 100 will remain the position shown in FIG. 5, but the gate element 142 for the downstream buckle chute 102 will be moved to the position shown in FIG. 6 so as to divert the sheet into that buckle chute for folding, after which it will be directed to the accumulating device 22 and stacked with the other items previously fed thereto. Since the collation will be complete at this point, the microprocessor now causes the accumulating device 22 to move the collation to the inserting machine 24 where the collation will be inserted into a mailing envelope by any of a number of techniques known in the art. As soon as the collation leaves the accumulating device 22, the microprocessor causes the above sequence of events to be repeated to create the next dynamically controlled collation.

It is to be understood that the present invention is not to be considered as limited to the specific embodiment described above and shown in the accompanying drawings, which is merely illustrative of the best mode presently contemplated for carrying out the invention and which is susceptible to such changes as may be obvious to one skilled in the art, but rather that the invention is intended to cover all such variations, modifications and equivalents thereof as may be deemed to be within the scope of the claims appended hereto.

We claim:

1. A sheet processing machine for selectively feeding and folding sheets either from a source contained within said processing machine or fed from an external source to an input end of said processing machine, and for accumulating said sheets from either or both of said sources to form collations thereof for further processing, said processing machine comprising A. first and second sets of feeding and folding rollers defining a main path of travel for sheets through a portion of said machine and having upstream and downstream ends, B. sheet storage and feeding means mounted in said machine adjacent said upstream end of said main path of travel for storing sheets to be formed into discrete collations, C. first and second input feeding means for feeding sheets from said storage and feeding means and from said external source respectively, said first and second input feeding means being disposed adjacent said upstream end of said main path of travel for feeding sheets into said main path of travel from both said sheet storage and feeding means and from said external source, D. first and second buckle chutes having inlet ends disposed in operative relationship with said first and second sets of feeding and folding rollers respectively for selectively receiving sheets to be folded from said first and second sets of feeding and folding rollers, E. sheet accumulating means disposed adjacent said downstream end of said main path of travel for accumulating sheets fed either directly through said path of travel to said accumulating means or through one or the other or both of said buckle chutes and then to said accumulating means, and F. sheet directing means disposed adjacent said inlet ends of said first and second buckle chutes for directing sheets from either of said first or second input feeding means either directly through said first and second sets of feeding and folding rollers and along said main path of travel directly to said accumulating means, or alternatively for diverting said sheets out of said main path of travel and into one or the other or both of said buckle chutes for folding of said sheets and then feeding to said accumulating means,whereby sheets from either said internal storage and feeding means or said external source can be fed directly to said accumulating means without being folded to form discrete collations of unfolded sheets, or can be fed selectively from either of said sources to either or both of said first and second buckle chutes to be folded in different configurations and then fed to said accumulating means to form discrete collations of folded sheets and mixed unfolded and folded sheets.

2. A sheet processing machine as set forth in claim 1 wherein

A. said first input feeding means is disposed intermediate said sheet storage and feeding means and said first set of feeding and folding rollers and defines a first entrance path along which sheets in said sheet storage and feeding means are fed therefrom to said first set of feeding and folding rollers, and B. said second input feeding means is disposed intermediate said input end of said machine and said first set of feeding and folding rollers and defines a second entrance path along which sheets from said external source are fed from said input end of said machine to said first set of feeding and folding rollers, whereby said first and second entrance paths direct sheets from both said sheet storage and feeding means and said external source respectively to said main path of travel.

3. A sheet processing machine as set forth in claim 2 wherein each of said first and second sets of feeding and folding rollers each comprises A. first, second and third feeding rollers mounted so as to have the peripheries of said first and second rollers, and said second and third rollers, in cooperating feeding engagement with each other, but said first and third rollers being mounted so as to have the peripheries thereof in spaced relationship with each other, and B. said sheet directing means being disposed in said space between said first and third rollers of each of said first and second sets of feeding and folding rollers.

4. A sheet processing machine as set forth in claim 3 wherein said sheet directing means comprises first and second gating means mounted for movement between alternate positions for selectively directing sheets out of said main path of travel and into said inlet ends of said buckle chutes when said sheets are to be folded.

5. A sheet processing machine as set forth in claim 4 wherein said first and second gating means each comprises A. an elongate gate element mounted to extend laterally across said main path of travel and for oscillatory movement between first and second positions, said gate element having a guide surface for directing sheets from said first and second rollers of each of said sets of feeding and folding rollers into said inlet ends of said buckle chutes, or alternatively from said first and second rollers directly to said second and third rollers, depending on whether said gate element is disposed in said first or second position, and B. selectively operable means for controlling the movement of said gate element through said oscillatory movement between said first and second positions.

6. A sheet processing machine as set forth in claim 5 wherein said selectively operable means comprises A. individual actuating means operatively connected to each of said gate elements for moving said gate elements between said first and second positions, and B. control means operable to control the activation of said actuating means to cause sheets from said sheet storage and feeding means and said external source to be directed along said main path of travel and by-pass said inlet ends of said buckles chutes, or alternatively to cause sheets from either said sheet storage and feeding means or said external source to be directed into said inlet ends of one or the other, or both, of said first and second buckles chutes.

7. A sheet folding and accumulating machine as set forth in claim 6 wherein said control means includes a microprocessor having user operable data input means for selecting the order of operation of feeding of sheets either from said sheet storage and feeding means or from said external source, and for selecting the order of operation of said gate elements for directing sheets from either said storage and feeding means or said external source directly along said main feed path to said accumulating means or for diverting sheets from either said sheet feeding and storage means or said external source through one or the other, or both, of said first and second buckle chutes for each collation that is to be formed in said accumulating means.

8. A sheet processing machine for controlling sheet processing within a batch run, said processing machine comprising:

A. an upstream feed path;

B. a downstream feed path;

C. a first buckle chute folder and a second buckle chute folder each of said buckle chute folders having inlet ends operatively positioned between said upstream path and said downstream path for receiving a sheet;

D. said inlet ends of said buckle chutes including gates; and

E. a dynamically controlled means for enabling said gates to be selectively activated or deactivated while said machine is in process of a single batch run, such that said sheets are selectively directed out of said main path of travel and into said activated gates of either the first, the second, or both buckle chute folders.

9. The sheet processing machine as claimed in claim 8 further including a plurality of input feed means adjacent said upstream end of said main path of travel.

10. The sheet processing machine as claimed in claim 9 further including a means for selectively feeding said sheets from said plurality of input feed means to said main path of travel.

11. The sheet processing machine as claimed in claim 8 wherein said gates further include a guide surface extending across said inlet ends and laterally across said main path of travel.

12. The sheet processing machine as claimed in claim 8 further including an accumulator operatively positioned adjacent said downstream feed path for receiving mixed collations of folded and unfolded sheets.

13. The sheet processing machine as claimed in claim 8 wherein said dynamically controlled means includes a microprocessor having user operable data input means for selecting the activation of said gates.

* * * * *